US007662235B2

(12) United States Patent
Yoshida et al.

(10) Patent No.: US 7,662,235 B2
(45) Date of Patent: Feb. 16, 2010

(54) METHOD OF CLEANING ETCHING APPARATUS

(75) Inventors: Atsushi Yoshida, Kudamatsu (JP); Kotaro Fujimoto, Kudamatsu (JP); Takeshi Shimada, Hikari (JP)

(73) Assignee: Hitachi High-Technologies Corporation, Tokyo (JP)

( * ) Notice: Subject to any disclaimer, the term of this patent is extended or adjusted under 35 U.S.C. 154(b) by 704 days.

(21) Appl. No.: 11/203,092

(22) Filed: Aug. 15, 2005

(65) Prior Publication Data

US 2006/0191555 A1 Aug. 31, 2006

(30) Foreign Application Priority Data

Feb. 28, 2005 (JP) ..... 2005-052434

(51) Int. Cl.
*B08B 3/12* (2006.01)
*B08B 6/00* (2006.01)

(52) U.S. Cl. ..... 134/1; 134/1.1

(58) Field of Classification Search ..... None
See application file for complete search history.

(56) References Cited

U.S. PATENT DOCUMENTS 5,817,578 A * 10/1998 Ogawa ..... 438/714
6,068,729 A * 5/2000 Shrotriya ..... 156/345.26
6,852,242 B2 * 2/2005 Sun et al. ..... 216/60
2004/0082186 A1 * 4/2004 Okamoto ..... 438/709
2004/0084409 A1 * 5/2004 Deshmukh et al. ..... 216/63
2004/0103914 A1 * 6/2004 Cheng et al. ..... 134/1.1

FOREIGN PATENT DOCUMENTS

JP 06-053193 2/1994
JP 09-036085 2/1997
JP 2000-012515 1/2000

* cited by examiner

*Primary Examiner*—Duy-Vu N Deo
(74) *Attorney, Agent, or Firm*—Antonelli, Terry, Stout & Kraus, LLP.

(57) ABSTRACT

To provide a cleaning method for an etching apparatus for a metal film that efficiently removes an etching residue deposited in an etching process chamber, assures the reproducibility of the etching performance, and keeps the etching process chamber in a low-dust-emission condition.

Each time one workpiece with a metal film is etched (S1), the interior of the vacuum chamber is cleaned by replacing the workpiece with a dummy substrate (S2), performing a first step of plasma processing using oxygen ($O_2$) and carbon tetrafluoride ($CF_4$) to remove a carbon-based deposit pile (S3), and performing a second step of plasma processing using boron trichloride ($BCl_3$) and chlorine ($Cl_2$) to remove a residue that could not be removed by the first step and an etching residue of the metal film (S4).

5 Claims, 9 Drawing Sheets

STATE OF INTERIOR OF APPARATUS AFTER ETCHING

STATE OF INTERIOR OF APPARATUS AFTER PLASMA PROCESSING USING OXYGEN ($O_2$) AND CARBON TETRAFLUORIDE ($CF_4$)

ETCHING RATE AT INNER WALL OF CHAMBER

| KIND OF FILM | FARADAY SHIELD VOLTAGE | |
|---|---|---|
| | 2000V | 100V |
| $Al_2O_3$ | 65nm/min | 16nm/min |
| Au | 55nm/min | 6nm/min |

METHOD OF CLEANING ETCHING APPARATUS

The present application is based on and claims priority of Japanese patent application No. 2005-052434 filed on Feb. 28, 2005, the entire contents of which are hereby incorporated by reference.

BACKGROUND OF THE INVENTION

1. Field of the Invention

The present invention relates to a method of cleaning a dry-etching apparatus. In particular, it relates to a cleaning method for an etching apparatus for a semiconductor device, the method being provided to assure that the etching rate of a film to be etched, the in-plane uniformity of etching rate of the film to be etched and the etching rate ratio (selectivity rate) between the film to be etched and a mask material or an underlying material are less variable and reproducible and to keep a stable apparatus condition by minimizing emission of foreign matters in the apparatus.

2. Description of the Related Art

In manufacturing processes of semiconductor devices, etching techniques are used for forming fine patterns. The etching techniques are classified into the dry etching type and the wet etching type, and the dry etching technique has recently become mainstream due to its high workability. Known dry etching techniques include microwave plasma etching and reactive ion etching, both of which involve introducing an etching gas to a vacuum vessel and exciting the etching gas into a plasma using cyclotron resonance or high-frequency electric field, thereby etching a film to be etched.

On the other hand, as an element wiring material for semiconductor devices, aluminum (Al) is used. With the recent increase of the packaging density of semiconductor devices, the elements are becoming smaller and smaller, and materials that are more chemically stable and have lower resistances are attracting more attention. For example, gold (Au) is considered as an alternative to aluminum. Besides, a film of platinum (Pt), silver (Ag), titanium (Ti), titanium nitride (TiN), titanium oxide (TiO) or an aluminum alloy or a stack of films of these materials may be used. In addition, the device structure is becoming thinner, and the photoresist (PR), the oxide ($SiO_2$) film, the titanium (Ti) film, and the titanium nitride (TiN) film serving as a mask, and the oxide ($SiO_2$) film and an organic film serving as a base material are required to have a high selectivity.

In order to achieve a high selectivity, etching may be conducted using, as an etching gas, a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr).

However, since a hydrocarbon (CH)-based gas is used as the additive gas, a hydrocarbon (CH)-based product is deposited in the apparatus during etching of the film to be etched. In addition, an etching residue of the film to be etched and a reaction product as a result of reaction of the film to be etched and the etching gas are not discharged and are deposited in the apparatus. Such deposite piles all cause reduction of etching performance and occurrence of a foreign matter and, therefore, have to be removed as required.

In order to remove the deposite pile in the vacuum vessel, dry cleaning that involves plasma processing or wet cleaning that involves opening the vessel to the atmosphere may be utilized. Typically, from the viewpoint of the productivity of the semiconductor device, the dry cleaning, which can be done in a shorter time, is selected. For example, known conventional dry cleaning techniques are as follows:

(1) a method of removing a carbon-based deposite pile (see Japanese Patent Publication No. 6-53193 or Japanese Patent Publication No. 9-36085, for example); and (2) a method of removing a deposite pile of aluminum (Al), titanium nitride (TiN) or an aluminum alloy (see Japanese Patent Publication No. 2000-12515, for example).

The methods described above are to remove the deposite pile in the vacuum chamber by plasma processing using a selected cleaning gas. There has not been disclosed any method for removing a deposite pile formed when a film of gold (Au), platinum (Pt), silver (Ag), titanium (Ti), titanium nitride (TiN), titanium oxide (TiO), aluminum (Al) or an aluminum alloy or a stack of the films is etched using a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr).

SUMMARY OF THE INVENTION

An object of the present invention is to provide a cleaning method for removing, as required, a deposite pile in a vacuum chamber in which a film of gold (Au), platinum (Pt), silver (Ag), titanium (Ti), titanium nitride (TiN), titanium oxide (TiO), aluminum (Al) or an aluminum alloy or a stack of the films is etched using, as an etching gas, a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr), the cleaning method being provided to assure that the etching rate of the film to be etched, the in-plane uniformity of etching rate of the film to be etched and the etching rate ratio (selectivity rate) between the film to be etched and a mask material or an underlying material are less variable and reproducible even when a large quantity of substrates are etched and to keep a stable apparatus condition by minimizing dust emission.

If the metal film as described above is etched using a plasma of a mixed gas of a Cl-based or Br-based gas and an additive CH-based gas as an etching gas, an etching residue of the metal film, a substance contained in the mask material, a Cl-based or Br-based material and a CH-based material contained in the etching gas, a reaction product resulting from reaction of the metal film and the etching gas or the like is deposited in the vacuum chamber.

In order to attain the object, the present invention provides a method of cleaning an etching apparatus that conducts etching of a film to be etched made of gold (Au), platinum (Pt), silver (Ag), titanium (Ti), titanium nitride (TiN), titanium oxide (TiO), aluminum (Al) or an aluminum alloy or a stack of the films using as an etching gas a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr), in which each time etching of the film to be etched is completed, the film to be etched is replaced with a dummy substrate, and a plasma is produced, thereby cleaning the interior of a process chamber.

In addition, according to the present invention, in the method of cleaning an etching apparatus described above, the interior of the process chamber is cleaned by successively performing a first step of cleaning using a plasma of a mixed gas of oxygen ($O_2$) and carbon tetrafluoride ($CF_4$) or a plasma of a mixed gas of oxygen ($O_2$) and trifluoromethane ($CHF_3$)

and a second step of cleaning using a plasma of a mixed gas of boron trichloride ($BCl_3$) and chlorine ($Cl_2$).

Specifically, according to the present invention, in the cleaning method for removing a deposite pile in a vacuum chamber of an etching apparatus, each time etching of one metal film is completed, the metal film in the vacuum chamber is replaced with a dummy substrate, and a first step of plasma processing using a plasma of a mixed gas of 87.0-95.2% of oxygen ($O_2$) and 4.8-13.0% of carbon tetrafluoride ($CF_4$) is performed under a processing pressure of 5-12 Pa for 20-90 seconds, and subsequently, a second step of plasma processing using a plasma of a mixed gas of 10.0-30.0% of boron trichloride ($BCl_3$) and 70.0-90.0% of chlorine ($Cl_2$) is performed for 20-90 seconds.

As will be apparent from the above description, in the cleaning method according to the present invention, each time etching of one metal film is completed, the workpiece is replaced with a dummy substrate, and a first step of plasma processing using a mixed gas of oxygen ($O_2$) and carbon tetrafluoride ($CF_4$) is performed, and subsequently, a second step of plasma processing using a mixed gas of boron trichloride ($BCl_3$) and chlorine ($Cl_2$) is performed. As a result, even if a large quantity of semiconductor devices are etched, the etching performance is not degraded, the reproducibility of the etching performance is maintained, and the etching process chamber can be kept in a low-dust-emission condition.

DETAILED DESCRIPTION OF THE PREFERRED EMBODIMENTS

In the following, a method of cleaning a dry etching apparatus according to an embodiment of the present invention will be described with reference to FIGS. 1 to 9 and Tables 1 to 4. The dry etching apparatus used herein to which the cleaning method according to the present invention is applied is an apparatus for etching a workpiece formed on a semiconductor substrate that is supplied with a plasma-forming gas to produce a gas plasma, thereby etching a metal film formed on the substrate. The plasma etching apparatus may be a microwave plasma etching apparatus, an inductively coupled plasma etching apparatus, a helicon plasma etching apparatus, a dual frequency excitation parallel plate plasma etching apparatus.

Figure 1:
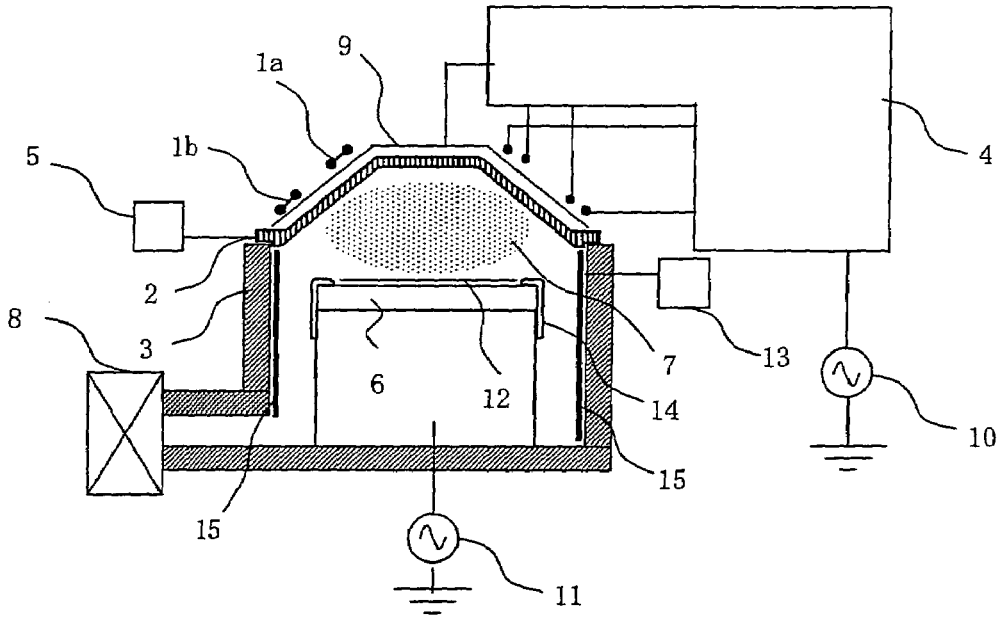
FIG. 1 is across-sectional view of a processing apparatus according to an embodiment of the present invention.

FIG. 1 is a cross-sectional view of a plasma etching apparatus used in the present invention. The plasma etching apparatus has a process chamber comprising a discharge section 2 that constitutes a plasma producing section and is made of a non-conductive material, such as quartz and ceramic, and a processing section 3 in which a workpiece 12 to be processed and an electrode 6 are disposed. The processing section 3 is grounded, and the electrode 6 is attached to the processing section 3 via an insulating material. For producing plasma, the discharge section 2 is provided with inductively coupled antennas 1*a* and 1*b*, a rectifier 4, a first high-frequency power supply 10 and the like. As a typical example, the plasma etching apparatus used in this embodiment is an etching apparatus whose inductively coupled antennas 1*a* and 1*b* are coil-shaped and disposed around the outside of the discharge section 2. A gas supply unit 5 supplies a process gas to the process chamber, while an exhaust unit 8 evacuates and decompresses the process chamber to a predetermined pressure. The process gas, which is introduced to the process chamber from the gas supply unit 5, is changed into plasma by an electric field generated by the inductively coupled antennas 1*a* and 1*b*. Besides, a second high-frequency power supply 11 apples a bias voltage to the electrode 6 to draw ions in the plasma 7 to the space above the workpiece 12. A light emission monitoring unit 13 detects the intensity of the light emission of the etching gas or a change of intensity of the light emission of a reaction product, and based on the detection result, the end point of etching is determined. The apparatus is designed for etching of a non-volatile material. By applying a voltage to a Faraday shield 9, deposition of a reaction product on the discharge section 2 can be suppressed, and if deposited, the reaction product on the discharge section 2 can be removed. The surface of an inner cover 15, which is disposed in the processing chamber 3, and the surface of the electrode 6 are roughened to prevent any reaction product once deposited thereon from peeling off. The back surface of a electrode cover 14 for fixing the workpiece 12 onto the electrode 6 is sprayed with a metal in order to suppress deposition of a reaction product to the surface of the electrode cover 14 due to voltage application from the plasma 7. These components are swap parts and can be readily replaced with new ones for maintenance, such as wet cleaning.

Figure 2:
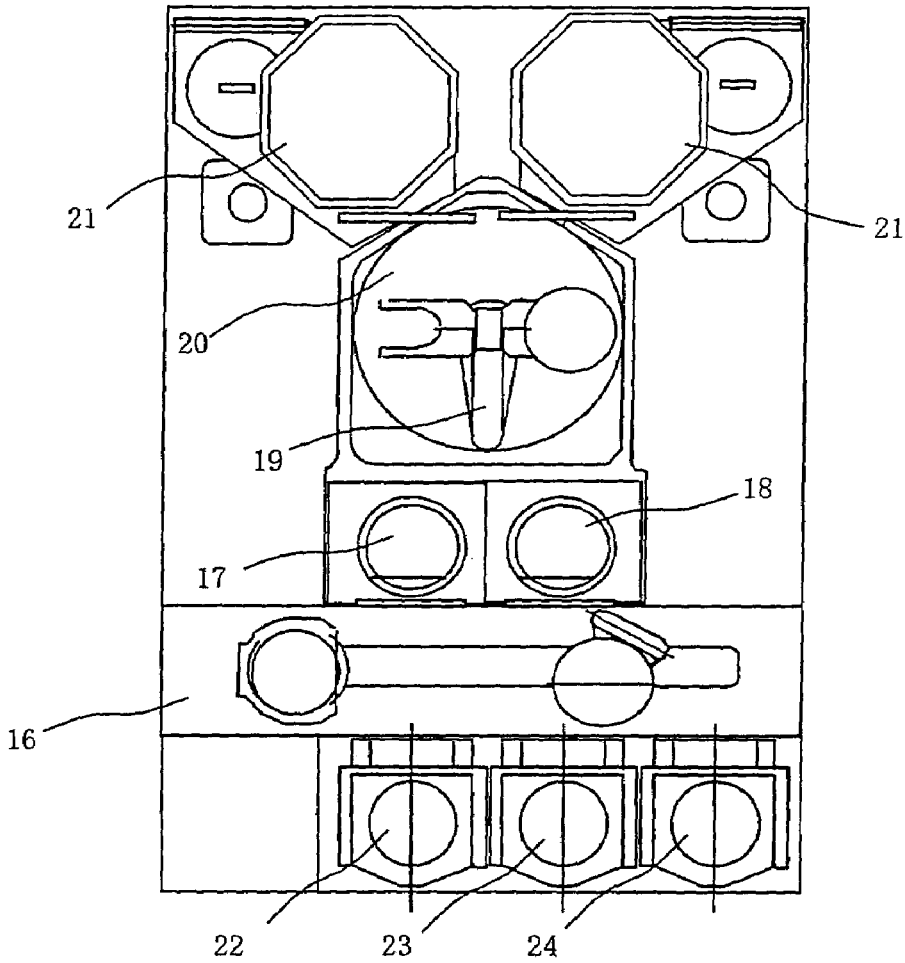
FIG. 2 is a top view showing an arrangement of the processing apparatus according to the embodiment of the present invention.

FIG. 2 shows an arrangement of the processing apparatus. An atmospheric loader 16 is connected to a load lock chamber 17 and an unload lock chamber 18, and the load lock chamber 17 and the unload lock chamber 18 is connected to a vacuum conveyance chamber 19. In addition, the vacuum conveyance chamber 19 is connected to an etching process chamber 21. The workpiece 12 is conveyed by the atmospheric loader 16 and a vacuum conveyance robot 20 and etched in the etching process chamber 21. On the atmospheric loader, there are provided a first and a second cassette 22 and 23 each for installing a workpiece 12 and a third cassette 24 for installing a dummy substrate wafer. There is no need of replacing a wafer to be etched in a cassette for installing a workpiece with a dummy wafer, and the workpiece 12 in the cassette can be conveyed into the etching process chamber 21, as required, and be returned into the original cassette after processing.

Figure 3:
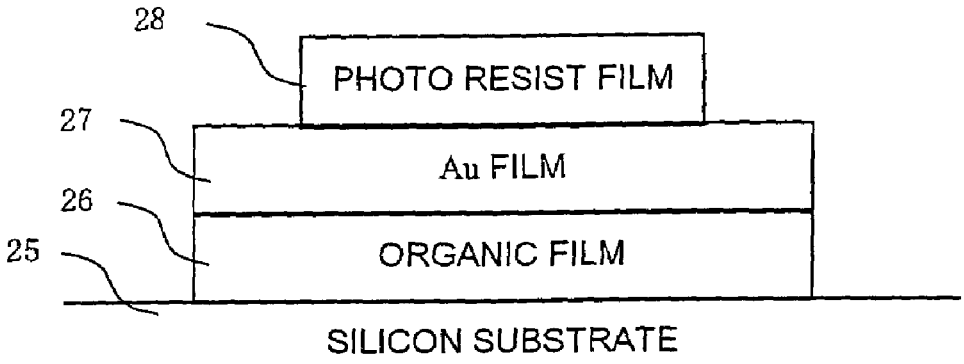
FIG. 3 is a cross-sectional view of a workpiece used in the embodiment of the present invention.

FIG. 3 shows an arrangement of a workpiece used in the present invention. An organic film 26 is formed on a semiconductor silicon substrate 25. An organic film is a film made of an organic polymer primarily containing carbon (C) and hydrogen (H) and possibly containing oxygen (O), nitrogen (N) and fluorine (F). For example, the organic film may be made of a polymer of a monomer, or a copolymer of monomers, selected from among olefins including ethylene, propylene and butylenes, aromatic vinyls including styrene and α-methyl styrene, unsaturated carboxylic acids including acrylic acid, methacrylic acid, 2-phenylacrylic acid, 2-acetylacrylic acid, maleic acid and fumaric acid, unsaturated carboxylic acid esters including methyl acrylate, ethyl acrylate, propyl acrylate, methyl methacrylate, ethyl methacrylate and propyl methacrylate, unsaturated carboxylic acid amides including acrylamide, methacrylamide, 2-phenyl acrylamide and 2-acetyl acrylamide, chemical compounds of unsaturated carboxylic acids including unsaturated carboxylic anhydride, such as maleic anhydride, and unsaturated compounds including vinyl acetate, vinyl chloride, vinylidene chloride, acrylonitrile and methacrylonitrile. Among others, acrylic (methacrylic) acid ester polymers, such as polyethyl acrylate and polymethyl methacrylate, and styrene resins, such as polystyrene, are suitable.

In particular, polyvinylidene fluoride is used in this embodiment. On the organic film 26, a gold (Au) film 27, which is to be etched, is formed. Finally, a photo resist (PR) 28, which serves as a mask, is formed for forming a pattern of an electronic circuit. In order to achieve micromachining, silicon dioxide ($SiO_2$), titanium (Ti), titanium nitride (TiN) or the like may be used as the mask material.

In order to selectively etch the Au film 27 to be etched and the underlying organic film 26, a mixed gas containing chlorine ($Cl_2$), argon (Ar) and dichloromethane ($CH_2Cl_2$) is used as an etching gas. Then, in the etching process chamber, gold (Au) sputtered during etching, a carbon-based substance contained in the photo resist (PR) serving as a mask, a chlorine ($Cl_2$)-based substance or a hydrocarbon (CH)-based substance contained in the etching gas, or a reaction product, such as gold chloride (AuCl) which is a reaction product of gold (Au) and chlorine ($Cl_2$), or the like is deposited. A significant amount of such a deposite pile in the etching process chamber cause deterioration of the reproducibility of the etching process. Furthermore, if such substances are floating in the process chamber, the substances are likely to fall onto the workpiece and serve as a mask, thereby hindering formation of a correct electronic circuit pattern.

According to the present invention, to always keep the interior of the etching process chamber clean, each time etching of one workpiece is completed, the workpiece is removed, and a dummy substrate is introduced into the etching process chamber to perform plasma cleaning. Since the deposite piles to be removed is those produced during etching of one workpiece, the plasma cleaning can be completed in a short time. Once the plasma cleaning is completed, the dummy substrate is replaced with another workpiece, and etching of the workpiece is performed. By repeating such a procedure, the interior of the etching process chamber can be always kept clean.

Figure 4A:
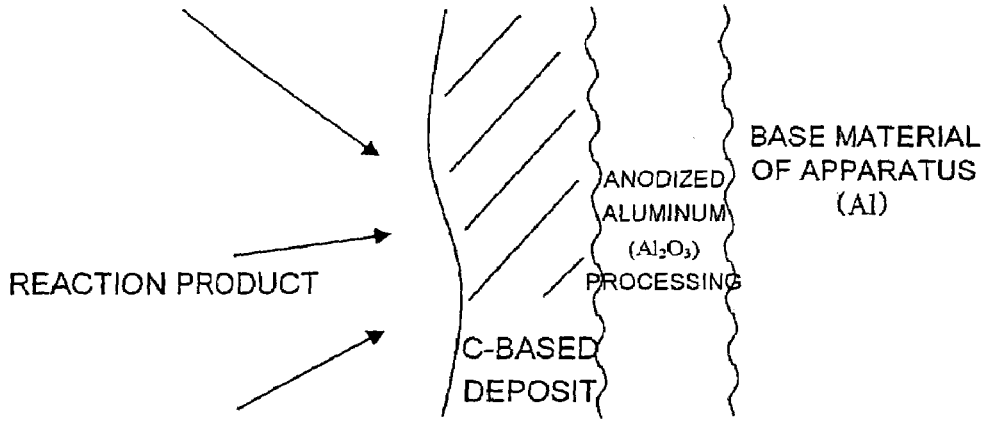
FIGS. 4*a* and 4*b* contain partially enlarged cross-sectional views for illustrating the interior of the apparatus according to the embodiment of the present invention, respectively after etching and after plasma processing using oxygen and carbon tetrafluoride.

Now, a gas used for plasma cleaning will be discussed. As shown in FIG. 4*a*, the inner surface of the process chamber is coated with a deposit. Analysis of the deposite pile on the surface of the chamber shows that the deposite pile contains C, N, Al, Si, Cl, Au and the like, and C is the main ingredient thereof. As a gas effective for removing C-based substances, an oxygen ($O_2$) plasma can be contemplated. Now, the etching rate of a photo resist (PR) containing a C-based substance as a main ingredient is investigated. It can be considered that, under a plasma condition that results in a higher etching rate, the C-based substance can be removed easier.

TABLE 1

Etching rate of photo resist in plasma processing using $O_2 + CF_4$

| condition | gas flow rate (ml/min) $O_2$ | gas flow rate (ml/min) $CF_4$ | processing pressure (Pa) | source high-frequency power (w) | bias high-frequency power (W) | Faraday shield voltage (v) | coil current ratio (—) | electrode temperature (° C.) | electrode height (mm) | photo resist etching rate (nm/min) |
|---|---|---|---|---|---|---|---|---|---|---|
| 1 | 500 | 0 | 5 | 1800 | 0 | 1500 | 0.8 | 40 | 30 | 220.2 |
| 2 | 500 | 25 | 5 | 1800 | 0 | 1500 | 0.8 | 40 | 30 | 689.6 |
| 3 | 500 | 50 | 5 | 1800 | 0 | 1500 | 0.8 | 40 | 30 | 715.0 |
| 4 | 500 | 75 | 5 | 1800 | 0 | 1500 | 0.8 | 40 | 30 | 740.3 |
| 5 | 500 | 100 | 5 | 1800 | 0 | 1500 | 0.8 | 40 | 30 | 701.3 |
| 6 | 500 | 50 | 10 | 1800 | 0 | 1500 | 0.8 | 40 | 30 | 975.1 |
| 7 | 500 | 50 | 12 | 1800 | 0 | 1500 | 0.8 | 40 | 30 | 1080.0 |

Table 1 shows a result of evaluation of the etching rate of the photo resist. When an oxygen ($O_2$) plasma is used, the etching rate is 220.2 nm/min. If carbon tetrafluoride ($CF_4$) is added to the oxygen plasma, the etching rate jumps to 689.6 nm/min. With the flow rate of oxygen ($O_2$) fixed at 500 ml/min, if the flow rate of carbon tetrafluoride ($CF_4$) added to the oxygen ($O_2$) increases from 25 ml/min to 50 ml/min and then to 75 ml/min, the etching rate also gradually increases. However, when the flow rate of the carbon tetrafluoride added to the oxygen reaches 100 ml/min, the etching rate decreases. An excessive amount of carbon tetrafluoride ($CF_4$) can cause reduction of the etching rate of the photo resist and production of less volatile AuF and, thus, can cause production of a foreign matter. In addition, carbon tetrafluoride can damage apparatus components in the etching process chamber, and thus, carbon tetrafluoride should not be excessively added. As for the processing pressure, as the processing pressure increases from 5 Pa to 10 Pa and then to 12 Pa, the etching rate also gradually increases, so that the higher the processing pressure, the more effectively the etching process can be achieved. However, in this embodiment, the processing pressure cannot be raised beyond 12 Pa because of the capability of the apparatus, and therefore, 12 Pa is defined as an upper limit. In summary, the C-based substance can be removed by appropriately setting the flow rate ratio of oxygen ($O_2$) to carbon tetrafluoride ($CF_4$) at 87.0-95.2% to 4.8-13.0%, the pressure at 5-12 Pa, and the processing time at 20-90 seconds.

Figure 4B:
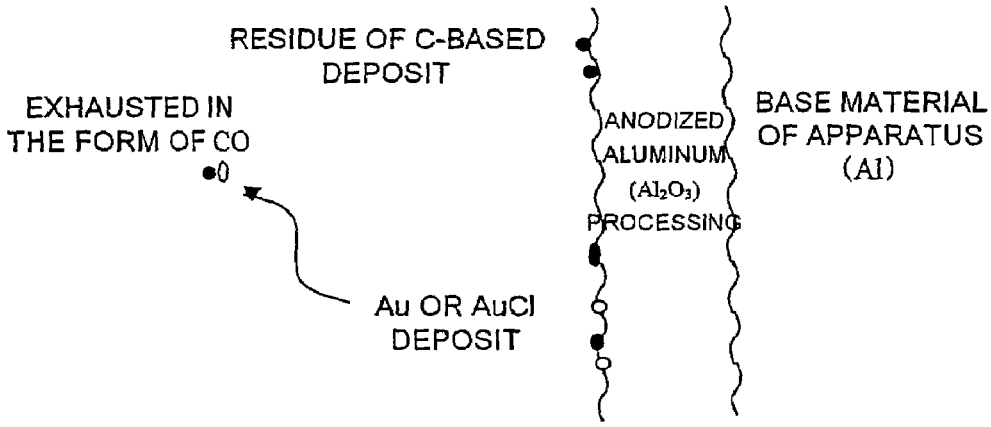

Most of the C-based substance can be removed by the procedure described above. However, the inner surface of the apparatus is uneven as shown in FIG. 4*b*, and therefore, a small amount of C-based substance or gold (Au) remains deposited thereon. In particular, gold (Au) is difficult to remove because gold is less chemically reactive. Thus, it can be contemplated that the underlying inner part of the apparatus is shaved slightly, and the deposite pile is removed together with the shavings. The inner part of the apparatus is made mainly of aluminum (Al) and is anodized and protected from corrosion. Therefore, the inner surface of the apparatus is made of $Al_2O_3$. Typically, as an etching gas for shaving $Al_2O_3$, boron trichloride ($BCl_3$) and/or chlorine ($Cl_2$) are used. Now, the etching rate of $Al_2O_3$ and the photo resist (PR) is investigated.

TABLE 2

Etching rate of photo resist and $Al_2O_3$ in plasma processing using $BCl_3 + Cl_2$

| condition | gas flow rate (ml/min) $BCl_3$ | gas flow rate (ml/min) $Cl_2$ | processing pressure (Pa) | source high-frequency power (W) | bias high-frequency power (W) | Faraday shield voltage (V) | coil current ratio (—) | electrode temperature (° C.) | electrode height (mm) | photo resist etching rate (nm/min) | $Al_2O_3$ etching rate (nm/min) |
|---|---|---|---|---|---|---|---|---|---|---|---|
| 1 | 0 | 100 | 0.5 | 1800 | 200 | 1500 | 0.8 | 40 | 30 | 477.5 | 19.3 |
| 2 | 10 | 90 | 0.5 | 1800 | 200 | 1500 | 0.8 | 40 | 30 | 459.6 | 25.0 |
| 3 | 20 | 80 | 0.5 | 1800 | 200 | 1500 | 0.8 | 40 | 30 | 441.7 | 29.1 |
| 4 | 30 | 70 | 0.5 | 1800 | 200 | 1500 | 0.8 | 40 | 30 | 420.1 | 31.4 |
| 5 | 40 | 60 | 0.5 | 1800 | 200 | 1500 | 0.8 | 40 | 30 | 364.3 | 33.6 |
| 6 | 60 | 40 | 0.5 | 1800 | 200 | 1500 | 0.8 | 40 | 30 | 287.0 | 38.0 |
| 7 | 80 | 20 | 0.5 | 1800 | 200 | 1500 | 0.8 | 40 | 30 | 210.0 | 42.1 |
| 8 | 100 | 0 | 0.5 | 1800 | 200 | 1500 | 0.8 | 40 | 30 | 75.4 | 45.0 |

Table 2 shows a result of evaluation of the etching rates. The flow rates of boron trichloride ($BCl_3$) and chlorine ($Cl_2$) are changed. Then, as the ratio of boron trichloride ($BCl_3$) increases, the etching rate of $Al_2O_3$ increases. On the other hand, as the ratio of chlorine ($Cl_2$) increases, the etching rate of the photo resist increases. Thus, in order to shave more $Al_2O_3$, it is preferred that the ratio of boron trichloride ($BCl_3$) is high. On the other hand, in order to remove more C-based substance, it is preferred that the ratio of chlorine ($Cl_2$) is high. However, if the ratio of boron trichloride ($BCl_3$) is too high, there is a possibility that all the anodized aluminum is shaved. It is desirable that the parts in the apparatus are used as long as possible, so that the amount of $Al_2O_3$ shaved has to be minimized. Therefore, the flow rate ratio between boron trichloride ($BCl_3$) and chlorine ($Cl_2$) has to be set at an optimal value that allows removal of the deposite pile and minimizes the amount of $Al_2O_3$ shaved. For example, it can be achieved by appropriately setting the flow rate ratio of boron trichloride ($BCl_3$) to chlorine ($Cl_2$) at 10.0-30.0% to 70.0-90.0% and the processing time at 20-90 seconds.

The etching and cleaning process described above will be described with reference to the flowchart of FIG. 5. A film to be etched on a wafer is etched (S1), and then, the wafer with the film etched is replaced with a dummy substrate (S2). Then, a plasma processing using oxygen ($O_2$) and carbon tetrafluoride ($CF_4$), which is a first step of the cleaning process, is performed (S3), and subsequently, a plasma processing using boron trichloride ($BCl_3$) and chlorine ($Cl_2$), which is a second step of the cleaning process, is performed (S4). Then, the dummy substrate is replaced with another wafer (S5), and then, a film to be etched of the wafer is etched (S1). By repeating this procedure, a large quantity of wafers can be etched.

Figure 6:
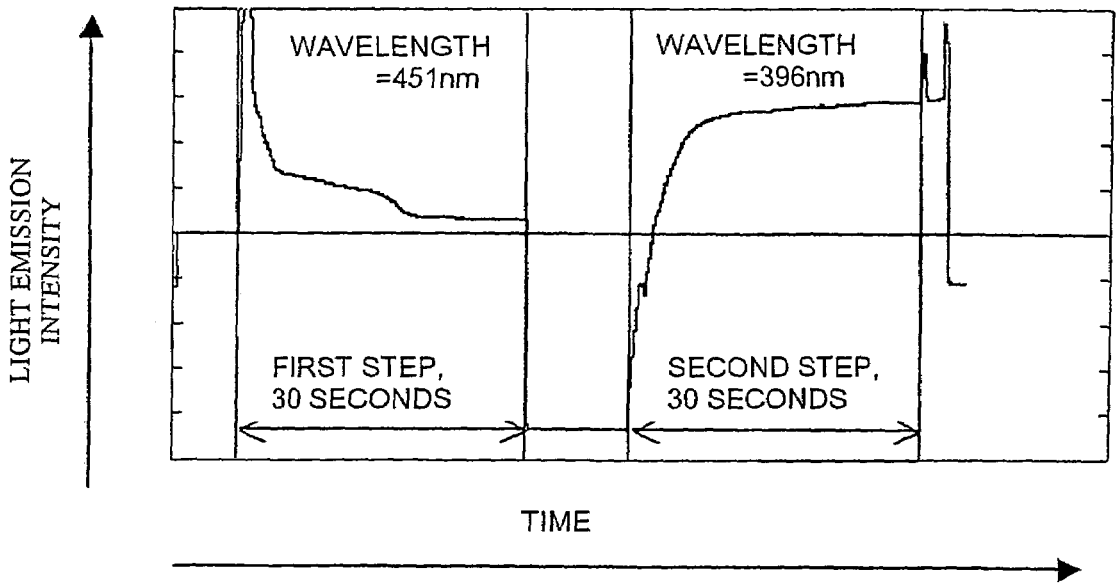
FIG. 6 shows a waveform for determining end points of process steps according to the embodiment of the present invention.

FIG. 6 shows a variation of the plasma emission strength during the plasma cleaning described above. In the first step, the wavelength of 451 nm concerning a CO-based substance is observed, and in the second step, the wavelength of 396 nm concerning an AlCl-based substance is observed. In the first step, the emission light intensity gradually decreases and is stabilized in 20 seconds. From this fact, it can be considered that the C-based substance is completely removed in 20 seconds. In the second step, the emission light intensity gradually increases and is stabilized in 10 seconds. From this fact, it can be considered that $Al_2O_3$, which is the material of the apparatus, is exposed, and thus, the deposite pile is completely removed. Thus, it is considered that the deposite pile in the apparatus can be completely removed by performing each step of the plasma cleaning for 20 seconds or longer. However, a long-duration plasma cleaning causes reduction of productivity, and thus, the duration of each step should be limited to 90 seconds.

Now, a result of cleaning of a thousand of workpieces as shown in FIG. 3 using the cleaning method according to the present invention will be described. Table 3 shows conditions of etching of the workpiece shown in FIG. 3. Table 4 shows conditions of plasma cleaning performed after each etching.

TABLE 3

Etching condition in this embodiment

| step | gas flow rate (ml/min) $Cl_2$ | gas flow rate (ml/min) Ar | gas flow rate (ml/min) $CH_2Cl_2$ | processing pressure (Pa) | source high-frequency power (W) | bias high-frequency power (W) | Faraday shield voltage (V) | coil current ratio (—) | electrode temperature (° C.) | electrode height (mm) | duration (s) |
|---|---|---|---|---|---|---|---|---|---|---|---|
| 1 | 30 | 50 | 0 | 0.2 | 600 | 100 | 900 | 0.8 | 40 | 30 | 20 |
| 2 | 8 | 77 | 15 | 0.2 | 600 | 100 | 900 | 0.8 | 40 | 30 | 100 |

TABLE 4

Cleaning condition in this embodiment

| step | gas flow rate (ml/min) $O_2$ | $CF_4$ | $BCl_3$ | $Cl_2$ | processing pressure (Pa) | source high-frequency power (W) | bias high-frequency power (W) | Faraday shield voltage (V) | coil current ratio (—) | electrode temperature (° C.) | electrode height (mm) | duration (s) |
|---|---|---|---|---|---|---|---|---|---|---|---|---|
| 1 | 500 | 50 | 0 | 0 | 10 | 1800 | 0 | 1500 | 0.8 | 40 | 30 | 60 |
| 2 | 0 | 0 | 15 | 80 | 0.5 | 1800 | 200 | 1500 | 0.8 | 40 | 30 | 60 |

Figure 7:
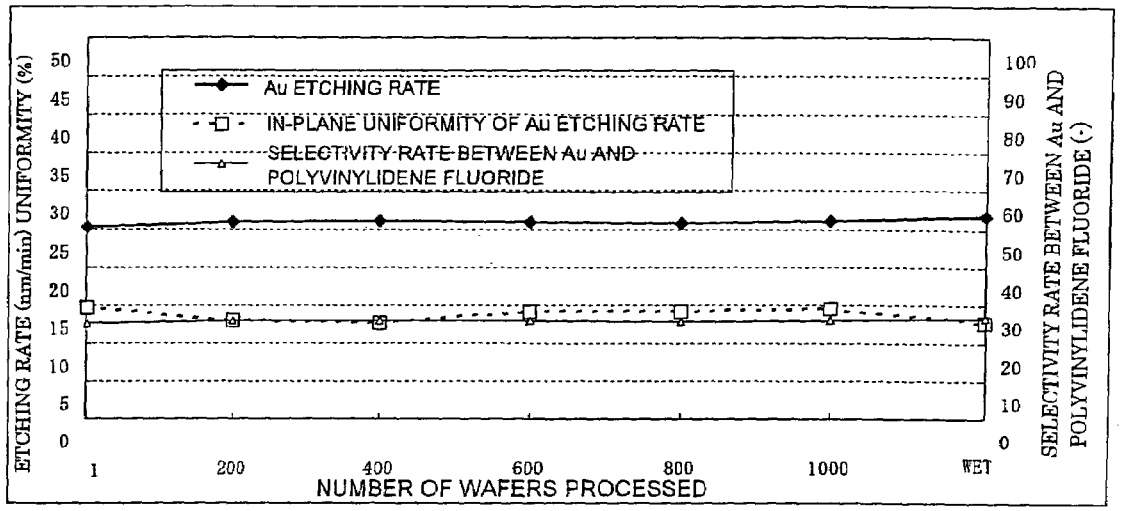
FIG. 7 is a graph showing an etching performance result according to the embodiment of the present invention.
Figure 8:
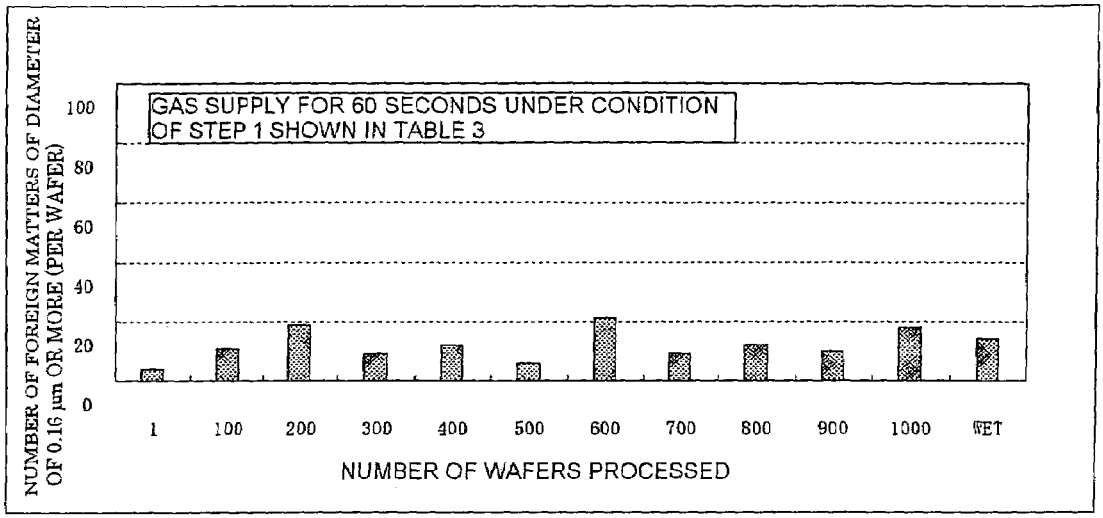
FIG. 8 is a graph showing a foreign matter measurement result according to the embodiment of the present invention.

FIG. 7 shows etching performance versus number of processed wafers. The etching performance is evaluated in terms of etching rate of gold (Au), in-plane uniformity of etching rate of gold (Au), and etching rate ratio (selectivity rate) between gold (Au) and the polyvinylidene fluoride film. FIG. 8 shows foreign matter measurement versus number of processed wafers. The foreign matter measurement is conducted by introducing a Si wafer to the process chamber, performing gas supply under the condition of the step 1 in Table 3 (except that the source high-frequency power is set at 0 W and the bias high-frequency power is set at 0 W) for 60 seconds, and then, counting the number of foreign matters on the Si wafer.

Figure 5:
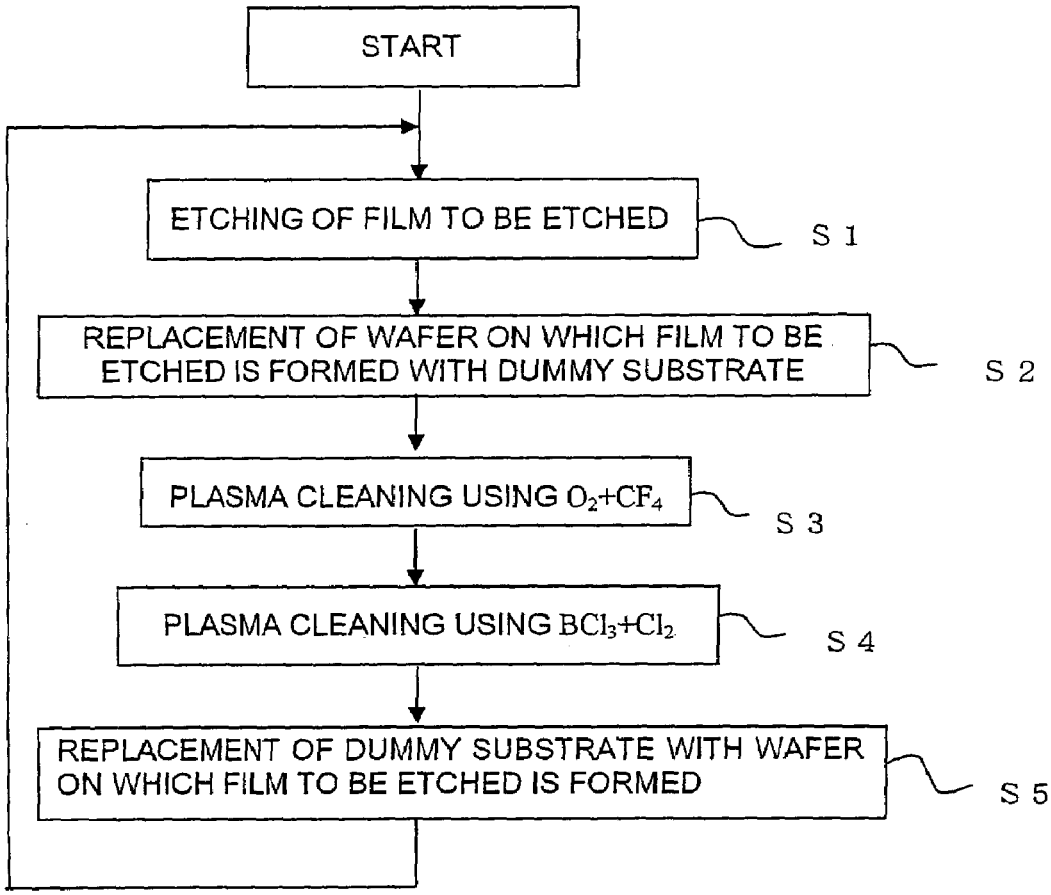
FIG. 5 is a flowchart for illustrating a processing sequence according to the embodiment of the present invention.

A thousand of wafers are processed according to the procedure shown in FIG. 5. Then, as shown in FIG. 7, the etching rate of gold (Au), the in-plane etching rate uniformity of gold (Au), and the etching rate ratio (selectivity rate) between gold (Au) and the polyvinylidene fluoride film do not vary significantly and are kept at a stable value. Thus, the etching performance is always kept constant.

In addition, as shown in FIG. 8, the number of foreign matters having a diameter of 0.16 μm or more is twelve on average. Thus, dust emission is kept low, and the interior of the process chamber is always kept clean. In this way, the cleaning method according to the present invention enables manufacture of semiconductor devices with high yield.

In the embodiment described above, the plasma cleaning is applied in the case where gold (Au) is etched using a mixed gas of chlorine ($Cl_2$), argon (Ar) and dichloromethane ($CH_2Cl_2$). However, the cleaning method according to the present invention can equally be applied in the case where a film of platinum (Pt), silver (Ag), titanium (Ti), titanium nitride (TiN), titanium oxide (TiO), aluminum (Al) or an aluminum alloy or a stack of the films, rather than a gold (Au) film, is etched using, as an etching gas, a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr).

In addition, trifluoromethane ($CHF_3$), rather than carbon tetrafluoride ($CF_4$), can be used with oxygen ($O_2$) in the first step of the plasma cleaning process to provide the same effect.

According to the procedure shown in FIG. 5, cleaning is performed after each etching. However, depending on the kind or thickness of the film to be etched, or the kind or flow rate of the etching gas, the amount of deposite pile in the apparatus varies. Thus, in some cases, cleaning can be performed each time two, three or n wafers are etched to provide the same effect.

Figure 9:
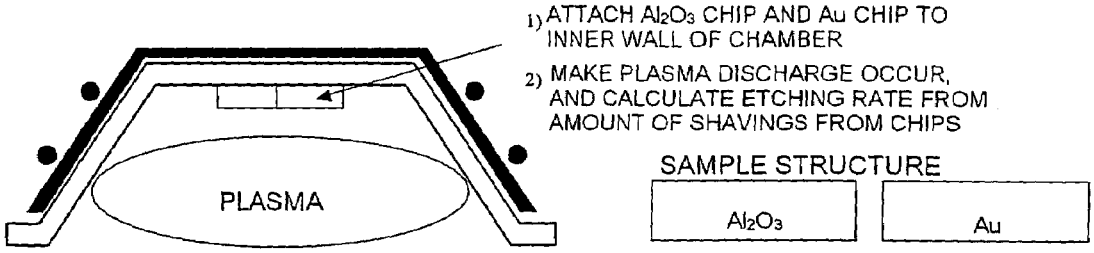
FIG. 9 is a diagram for illustrating etching rates of workpieces on an inner wall of a discharge section according to the embodiment of the present invention.

In addition, in the embodiment described above, the apparatus has a capability of suppressing deposition of a reaction product. Suppression of deposition of a reaction product onto the discharge section 2 and removal of the reaction product on the discharge section 2 can be achieved by applying a voltage to the Faraday shield 9 shown in FIG. 9. The voltage applied to the Faraday shield 9 can be varied, so that the condition of the inner wall of the discharge section 2 can be modified. FIG. 9 shows the etching rates of $Al_2O_3$ and Au in the case where the voltage applied to the Faraday shield is varied. An $Al_2O_3$ workpiece and an Au workpiece are attached to the inner wall at the top of the discharge section, and the etching rates thereof are determined under the condition of the step 2 in Table 4 except that the Faraday shield voltage is set at 100 V and 2000 V. The result shows that as the Faraday shield voltage increases, the etching rate also increases. Thus, it can be said that as the Faraday shield voltage becomes higher, deposition of a reaction product can be suppressed more effectively, and a deposited reaction product can be removed more effectively. If etching is performed under a high-Faraday-shield-voltage condition, deposition of a reaction product onto the inner wall of the discharge section is suppressed. Thus, the amount of deposite pile in the apparatus is reduced, so that the duration of each cleaning and the number of cleanings can be reduced. From the viewpoint of productivity, the number of cleanings is preferably small.

What is claimed is:

1. A method of cleaning an etching apparatus that conducts etching of a film to be etched made of a stack of any one layer or more than one layer of gold (Au), platinum (Pt), silver (Ag), titanium (Ti), titanium nitride (TiN), titanium oxide (TiO), aluminum (Al) or an aluminum alloy using as an etching gas a mixed gas produced by adding at least one of methane ($CH_4$), ethane ($C_2H_6$), acetylene ($C_2H_2$), dichloromethane ($CH_2Cl_2$), dibromomethane ($CH_2Br_2$), chloromethane ($CH_3Cl$), bromomethane ($CH_3Br$) and fluoromethane ($CH_3F$) to at least one of chlorine ($Cl_2$), boron trichloride ($BCl_3$) and hydrogen bromide (HBr), wherein each time etching of the film to be etched is completed, the method of cleaning comprises:

replacing the substrate (wafer) on which the film to be etched is formed with a dummy substrate, and cleaning the interior of a process chamber of the etching apparatus by producing a plasma therein, wherein said cleaning the interior of the process chamber is performed by successively performing a first step of cleaning using a plasma of a mixed gas of 87.0-95.2% of oxygen ($O_2$) and 4.8-13.0% of carbon tetrafluoride ($CF_4$) under a processing pressure of 5-12 Pa for 20-90 seconds, and a second step of cleaning using a plasma of a mixed gas of 10.0-30.0% of boron trichloride ($BCl_3$) and 70.0-90.0% of chlorine ($Cl_2$) for 20-90 seconds, and wherein in the second step of cleaning, an etching residue of said film to be etched and $Al_2O_3$ underlying a reaction product formed as a result of reaction of said film to be etched and said etching gas are shaved, whereby said etching residue and said reaction product are removed.

2. The method of cleaning an etching apparatus according to claim 1, wherein in the first step of cleaning, C-based substances and CH-based substances are removed.

3. The method of cleaning an etching apparatus according to claim 1, wherein during said etching said film to be etched has a mask thereon, said mask being made of a photo resist.

4. The method of cleaning an etching apparatus according to claim 1, wherein during said etching said film to be etched has an organic film thereunder, said film to be etched and said organic film being etched during said etching, and wherein during said etching said film to be etched has a mask thereon, said mask being made of a photo resist.

5. The method of cleaning an etching apparatus according to claim 4, wherein in the first step of cleaning, C-based substances and CH-based substances are removed.

* * * * *